United States Patent [19]

Czitrom

[11] 4,042,290

[45] Aug. 16, 1977

[54] LIGHTING DEVICE

[75] Inventor: Georg Czitrom, Vaxjo, Sweden

[73] Assignee: Aneta Belysning AB, Vaxjo, Sweden

[21] Appl. No.: 669,969

[22] Filed: Mar. 24, 1976

[30] Foreign Application Priority Data

Apr. 14, 1975 Sweden ..... 7504278

[51] Int. Cl.[2] ..... H01R 33/04

[52] U.S. Cl. ..... 339/52 R

[58] Field of Search ..... 339/20–23, 339/50–56

[56] References Cited

U.S. PATENT DOCUMENTS

| | | | |
|---|---|---|---|
| 1,761,120 | 6/1930 | Graham et al. | 339/21 R |
| 2,052,312 | 8/1936 | Nielsen | 339/21 R |
| 2,945,202 | 7/1960 | Roney et al. | 339/50 R |

FOREIGN PATENT DOCUMENTS

| | | | |
|---|---|---|---|
| 370,780 | 10/1974 | Sweden | 339/50 R |

*Primary Examiner*—Roy Lake
*Assistant Examiner*—Neil Abrams
*Attorney, Agent, or Firm*—Pierce, Scheffler & Parker

[57] ABSTRACT

An illuminating device contains an elongated support having a U-shaped cross section. Tubular incandescent lamps are provided inside said support. Each lamp is carried by two lamp holders. The support consists of two metallic sections, each having an L-shaped cross section. The two sections are insulated from each other and are connected to the terminals of a low voltage electric supply.

5 Claims, 2 Drawing Figures

LIGHTING DEVICE

The invention relates to a lighting or illuminating device comprising an elongated support member having U-shaped cross-section, electric conductors along the inside of the support member, lamp holders displaceably arranged inside the support member, and incandescent lamps supported by said lamp holders, said incandescent lamps being of the type comprising a tubular section with caps at each end. A device of this type is disclosed in Swedish Pat. No. 370,780. In this known device each filament lamp is retained by a single lamp holder having two spring sections between which the lamp is clamped.

It is an object of the invention to provide an improved lamp holder for this type of lighting device. It is another object of the invention to provide an improved support for this type of lighting device.

The improved lamp holder of the invention is designed to support only one of the two caps of an incandescent lamp. Consequently, two lamp holders are required for carrying one lamp. The lamps may be of any desired length, because the distance between two adjacent lamp holders is easily adjusted. The improved lamp holder of the invention contains a contact spring abutting one of the electric conductors inside the elongated support member, and also abutting a cylindrical section of the incandescent lamp.

It is preferred to use tubular incandescent lamps for the lighting device of the invention. Such tubular lamps, having two end caps, are usual in automobiles. The caps on these lamps have a cylindrical section and a conical section. Since the lamp holder according to the invention cooperates with the cylindrical section of the cap, it is not necessary for two lamp holders with a lamp between them to be kept pressed towards each other. The lamp holder can be made extremely short, but it should preferably be somewhat longer than the length of the lamp cap. Two neighbouring lamps can then be placed close together without risk of contact between the two caps.

In known lighting devices of this type the electric conductors inside the elongated support have consisted of two strips of metal tape adhered by an electrically insulating adhesive to the inside of two opposing legs of the U-shaped support. As an alternative, only one strip of metal tape has been used, whereas the support itself, which has been made of metal, has formed the other conductor. However, it has been found that devices of this type have certain disadvantages. For example, the metal tape may become detatched, be torn by the lamp holders, or pulled off when the support is cut to the desired length. Furthermore, the support may become over-heated, especially if several incandescent lamps are placed close together in the support.

These drawbacks have been eliminated according to the invention by composing the support of two elongated metal sections having L-shaped cross-section, two legs of these sections being arranged parallel and spaced from each other and being joined to each other by means of spaced, electrically insulating spacers. Both the conductors are thus formed by the support itself. Some part of the inside of each L-shaped section should have a clean metal surface so that electric current can be transmitted to the lamp holders. The rest of the support is preferably varnished with an electrically insulating varnish. The insulating spacers joining the two L-shaped sections should be located at suitable intervals, for instance 10 cm from each other. Along the stretch between two adjacent spacers the L-shaped sections are separated only by an air gap. This air gap acts as ventilation opening and also prevents the support from becoming over-heated.

The invention will now be described with reference to the accompanying drawing.

Figure 1:
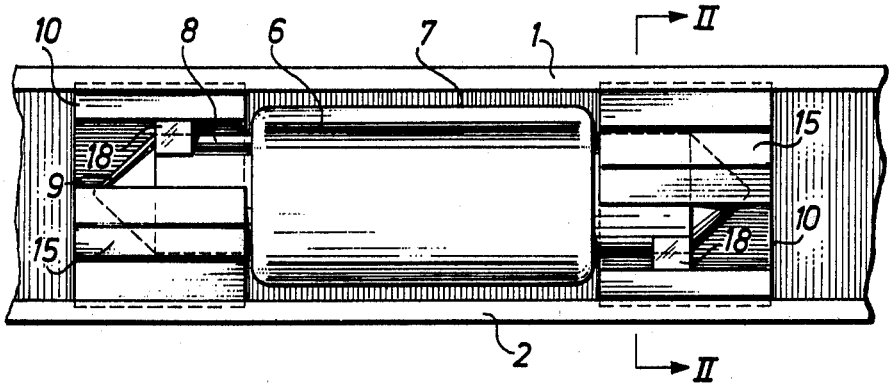
FIG. 1 shows a part of a support with two lamp holders and one lamp.
Figure 2:
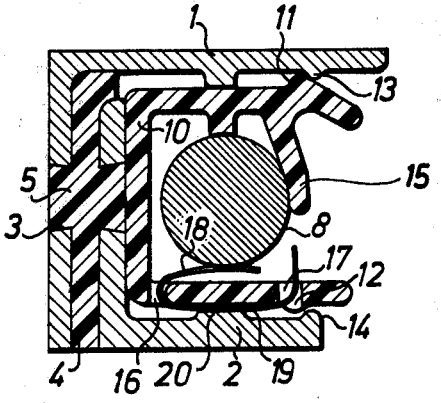
FIG. 2 shows a section along the line II—II in FIG. 1.

The illustration support consists of two elongated members 1 and 2, each having a generally L-shaped cross-section. The two members 1 and 2 are combined so as to form a support having a U-shaped cross-section. Apertures 3 with obliquely bevelled edges are arranged at suitable distances in the two legs of the members 1 and 2. A plastic spacer 4 having two opposing raised sections 5 is placed between the adjacent legs of the members 1 and 2 so that the raised sections 5 fit into the apertures 3. Pressure and heat are then applied to the raised sections 5 so that they are deformed and fill the apertures 3. The members 1 and 2 are thus mechanically connected and also electrically insulated by the plastic spacers 4. The members 1 and 2 are made of metal and function as current conductors. They are connected in a manner not shown to a power source having low voltage, preferably a transformer supplied from the electric mains.

An incandescent lamp 6 is shown in the support 1, 2, fitted in two lamp holders 10 made from an electrically insulating material. The lamp is of the known type consisting of a tubular glass part 7 with metal electrically conductive caps 8, 9 at both ends. Each cap consists of a cylindrical part 8 and a conical part 9. The lamp holders 10 are substantially U-shaped in profile. On the outside of the lamp holder are two protruding portions 11, 12 cooperating with two protruding portions 13, 14 on the inside of the support 1, 2 which thus establish coengaging releaseable means for retaining the lamp holders in the support, the lamp holders also being displaceable along the support with respect to each other. The lamp holder is preferably made of plastic and is easy to insert in the support 1, 2 by a spring action, the protruding portions 11, 12 snapping over the protruding portions 13, 14, thus retaining the lamp holder in the support. One leg of the lamp holder is provided with an inwardly protruding wall section 15 which holds a lamp cap 8 in the lamp holder. The other leg of the lamp holder is provided with two openings 16, 17. A contact spring extends through these openings, said contact spring having an inner section 18 which is in contact with the cylindrical part 8 of the lamp cap, and an outer section 19 which is in contact with a raised section 20 on the inside of the member 2.

When fitting in the lamp, it should be placed between two lamp holders turned 180° in relation to each other so that the contact spring of one of the lamp holders engages the member 1, and the contact spring of the other lamp holder engages the other member 2. The lamp holders are then moved towards each other so far that the inner sections 18 of the contact springs come into contact with the cylindrical parts 8 on the lamp caps.

What is claimed is:

1. Lighting device comprising an elongated support having a generally U-shaped cross-section, said support including electrically conductive surfaces extending respectively along the inside of the legs of said support, a pair of lamp holders made from an electrically insulating material displaceably arranged with respect to each other in said support, co-engaging releaseable means on said support and lamp holders for retaining said lamp holders in said support, an incandescent lamp of the type comprising a tubular section and an electrically conductive cap at each end thereof having a cylindrical section, each said cylindrical section being received in a corresponding one of said pair of lamp holders, and a contact spring on each said lamp holder connecting one cylindrical section of an end cap on said lamp with a corresponding one of said conductive surfaces extending along the inside of said support.

2. A lighting device as defined in claim 1 wherein said lamp holder which is made from a plastic material has a substantially U-shaped cross-section and is provided with a resilient wall section which engages and retains the end cap of said lamp in said holder.

3. A lighting device as defined in claim 1 wherein said co-engaging releaseable means on said support and lamp holders for retaining said lamp holders in said support comprise outwardly directed protruding portions on said lamp holders which engage inwardly directed protruding portions on said support.

4. Lighting device comprising an elongated support having a generally U-shaped cross-section and which is constituted by two interconnected L-shaped members made from an electrically conductive metallic material, longitudinally spaced lamp holders supported between two of the legs of said L-shaped members and the other two legs being arranged in an overlapping spaced relationship and joined to each other by means of spaced electrically insulating spacer members located therebetween, an incandescent lamp comprising a tubular section and electrically conductive end caps mounted on said lamp holders, and means establishing an electrical connection between each said end cap on said lamp and a corresponding L-shaped member.

5. A lighting device as defined in claim 4 wherein said spacers are constituted by plastic discs having raised sections fitting into apertures with obliquely bevelled edges in said overlapping legs.

* * * * *